US010493477B2

(12) United States Patent
Sacchet

(10) Patent No.: US 10,493,477 B2
(45) Date of Patent: Dec. 3, 2019

(54) DELIVERING DEVICE, IN PARTICULAR FOR PASTY OR CREAMY PRODUCTS

(71) Applicant: STAN ENGINEERING CORP. S.R.L., Salmour (IT)

(72) Inventor: Alessandro Sacchet, Salmour (IT)

(73) Assignee: Stan Engineering Corp. S.R.L., Salmour (IT)

( * ) Notice: Subject to any disclaimer, the term of this patent is extended or adjusted under 35 U.S.C. 154(b) by 0 days.

(21) Appl. No.: 14/911,453

(22) PCT Filed: Aug. 12, 2014

(86) PCT No.: PCT/IT2014/000215

§ 371 (c)(1),
(2) Date: Feb. 10, 2016

(87) PCT Pub. No.: WO2015/022713

PCT Pub. Date: Feb. 19, 2015

(65) Prior Publication Data

US 2016/0193618 A1 Jul. 7, 2016

(30) Foreign Application Priority Data

Aug. 12, 2013 (IT) ..... TO2013A0689

(51) Int. Cl.
*B05B 11/00* (2006.01)

(52) U.S. Cl.
CPC ..... *B05B 11/3052* (2013.01); *B05B 11/3045* (2013.01)

(58) Field of Classification Search
CPC ..... A47K 5/1211; A47K 5/1212; A47K 5/18; B05B 11/3045; B05B 11/3052
(Continued)

(56) References Cited

U.S. PATENT DOCUMENTS 671,153 A * 4/1901 Weihe ..... G01F 13/005 222/412
1,507,516 A * 9/1924 Richardson ..... A23G 9/28 222/145.3
(Continued)

FOREIGN PATENT DOCUMENTS

CN 101922955 A 12/2010
DE 102007024722 A1 7/2008
(Continued)

*Primary Examiner* — Patrick M. Buechner
*Assistant Examiner* — Michael J. Melaragno
(74) *Attorney, Agent, or Firm* — Avery N. Goldstein; Blue Filament Law PLLC

(57) ABSTRACT

A delivering device (1) is described, in particular for pasty or creamy products preferably for domestic use, comprising at least one delivery duct (3) which puts in fluid communication at least one internal volume (5) of at least one container (7), the internal volume (5) containing therein at least one product, and at least one delivery nozzle (9) for exiting the product by interposing pumping means (11) actuated by at least one actuating motor (13) to transfer amounts of the product from the internal volume (5) to the delivery nozzle (5) through the delivery duct (3), and control means (14) actuated by a user and operatively cooperating with the actuating motor (13) to allow or inhibit at will an operation of the actuating motor (13) and perform or stop a delivery of the product through the delivery nozzle (9).

10 Claims, 5 Drawing Sheets

(58) Field of Classification Search
USPC ..... 222/390, 571
See application file for complete search history.

(56) References Cited

U.S. PATENT DOCUMENTS 1,543,631 A * 6/1925 Todt ..... A47K 5/1211 222/390
1,659,254 A * 2/1928 Finger ..... A47K 5/1211 222/231
1,751,129 A * 3/1930 Cocks ..... A47K 5/1211 220/304
2,180,702 A * 11/1939 Berwick ..... G01F 11/32 222/321.6
2,686,618 A * 8/1954 Mateer ..... B65B 37/10 222/181.2
3,351,250 A * 11/1967 West ..... B65B 3/26 141/117
3,498,508 A * 3/1970 Niogret ..... B65B 3/16 141/90
3,806,084 A * 4/1974 Seese ..... F16K 23/00 137/625.38
3,840,154 A * 10/1974 Speak ..... A47K 5/1212 192/107 M
3,985,269 A * 10/1976 Bardeau ..... F25D 31/002 138/114
3,999,691 A * 12/1976 Doom ..... G01F 11/04 141/244
4,004,717 A * 1/1977 Wanke ..... B05B 9/00 222/255
4,053,012 A * 10/1977 Farmer ..... B22D 25/04 141/119
4,303,110 A * 12/1981 Chen ..... B65D 35/28 141/284
4,366,920 A * 1/1983 Greenfield, Jr. ..... A47J 31/401 222/145.5
4,494,677 A * 1/1985 Falcoff ..... B01F 15/0454 222/63
4,548,337 A * 10/1985 Morris ..... B65D 35/28 222/105
4,580,905 A * 4/1986 Schwitters ..... A23G 9/283 222/129.1
4,767,025 A * 8/1988 Gebauer ..... B01F 13/002 222/135
4,773,354 A * 9/1988 Wilbur ..... B05C 5/002 118/321
4,778,080 A * 10/1988 Ono ..... B67D 7/66 222/255
4,877,158 A * 10/1989 Kohler ..... B05B 9/0822 222/400.8
5,145,095 A * 9/1992 Loudon ..... A47K 5/18 141/352
5,494,193 A * 2/1996 Kirschner ..... B67D 1/0021 222/129.1
5,775,533 A * 7/1998 Schroeder ..... A23G 9/285 222/105
5,816,446 A * 10/1998 Steindorf ..... B01F 3/0861 222/1
5,829,636 A * 11/1998 Vuong ..... A47K 5/1217 222/109
5,953,567 A * 9/1999 Muramatsu ..... G03G 15/0822 222/DIG. 1
6,082,289 A * 7/2000 Cavallaro ..... B05C 11/1034 118/243
6,085,943 A * 7/2000 Cavallaro ..... G01F 11/021 222/309
6,227,420 B1 * 5/2001 Jepson ..... B65B 39/00 222/1
6,511,301 B1 * 1/2003 Fugere ..... B05C 11/10 222/251
6,553,779 B1 * 4/2003 Boyer ..... A23G 9/045 222/146.6
6,983,867 B1 * 1/2006 Fugere ..... B05C 11/10 222/261
7,192,267 B2 * 3/2007 Glucksman ..... A21C 11/18 222/326
7,815,072 B2 * 10/2010 Webster ..... G01F 11/46 222/1
8,123,063 B2 * 2/2012 Kanda ..... B65D 1/0292 220/229
8,240,508 B2 * 8/2012 Wegelin ..... B67D 1/0078 222/105
8,439,658 B2 * 5/2013 Johnson ..... F04C 2/1075 166/105
8,622,242 B2 * 1/2014 Pelfrey ..... A47K 5/1217 222/181.3
8,678,244 B2 * 3/2014 Yang ..... A47K 5/1202 222/321.9
2001/0052526 A1 * 12/2001 Kasahara ..... G03G 15/0855 222/95
2002/0166880 A1 * 11/2002 Taylor-McCune ..... B67D 1/101 222/571
2004/0050875 A1 * 3/2004 Kobayashi ..... G01F 13/005 222/333
2004/0206781 A1 * 10/2004 Lorscheidt ..... B05B 11/007 222/320
2005/0279783 A1 12/2005 Lo
2006/0173576 A1 * 8/2006 Goerg ..... A47K 10/3845 700/236
2006/0243740 A1 * 11/2006 Reynolds ..... A47K 5/1217 222/52
2007/0000941 A1 * 1/2007 Hadden ..... A47K 5/1217 222/52
2007/0029348 A1 * 2/2007 Glen ..... A47K 5/18 222/372
2007/0029349 A1 * 2/2007 Glen ..... B67D 7/58 222/372
2008/0264978 A1 * 10/2008 Rode ..... G01F 13/005 222/413
2008/0314935 A1 * 12/2008 Spargo ..... B65D 83/06 222/413
2009/0020564 A1 * 1/2009 Weiss ..... B05C 17/00569 222/333
2010/0102092 A1 * 4/2010 Sacchet ..... B01F 13/1055 222/412
2010/0122539 A1 * 5/2010 Cocchi ..... A23G 9/28 62/1
2010/0181337 A1 * 7/2010 Ikushima ..... B05C 5/0225 222/1
2011/0082595 A1 * 4/2011 Mehus ..... B67D 7/02 700/283
2013/0206789 A1 * 8/2013 Van Diepen ..... A47K 5/1217 222/52
2016/0193618 A1 * 7/2016 Sacchet ..... A47K 5/1211 222/23

FOREIGN PATENT DOCUMENTS

EP 1399370 B1 8/1993
EP 0428883 A1 3/2004

* cited by examiner

DELIVERING DEVICE, IN PARTICULAR FOR PASTY OR CREAMY PRODUCTS

The present invention refers to a delivering device, in particular for pasty or creamy products, preferably aimed for domestic use.

Many commonly used products are known in the art, such as for example foodstuff (sauces, creams, etc.), cosmetics and soaps having pasty or creamy consistence with classical reologic properties.

The products are usually sold in cans or small tubess so that the end user must then proceed, in order to use them, to take them from the containers either through a suitable tool (spoon, fork, knife, spatula, etc.) or through compression in order to deliver them from their related tube.

The art further proposes systems and devices which allow delivering and automatically batching pasty products like those disclosed, for example, in CN101922955, DE102007024722, EP1399370, EP0428883.

Object of the present invention is solving the above prior art problems, by providing an alternative delivering device which allows to practically, quickly and automatically deliver and possibly batch pasty or creamy products, such as food products, cosmetics, soaps, etc., preferably in a domestic use environment.

Another object of the present invention is providing a delivering device which allows to practically, quickly and automatically deliver and possibly batch pasty or creamy products directly from their own container, being both a can or a small tube.

The above and other objects and advantages of the invention, as will result from the following description, are obtained with a delivering device as claimed in claim 1. Preferred embodiments and non-trivial variations of the present invention are the subject matter of the dependent claims.

It is intended that all enclosed claims are an integral part of the present description.

It will be immediately obvious that numerous variations and modifications (for example related to shape, sizes, arrangements and parts with equivalent functionality) could be made to what is described, without departing from the scope of the invention as appears from the enclosed claims.

The present invention will be better described by some preferred embodiments thereof, provided as a non-limiting example, with reference to the enclosed drawings, in which.

Figure 1:
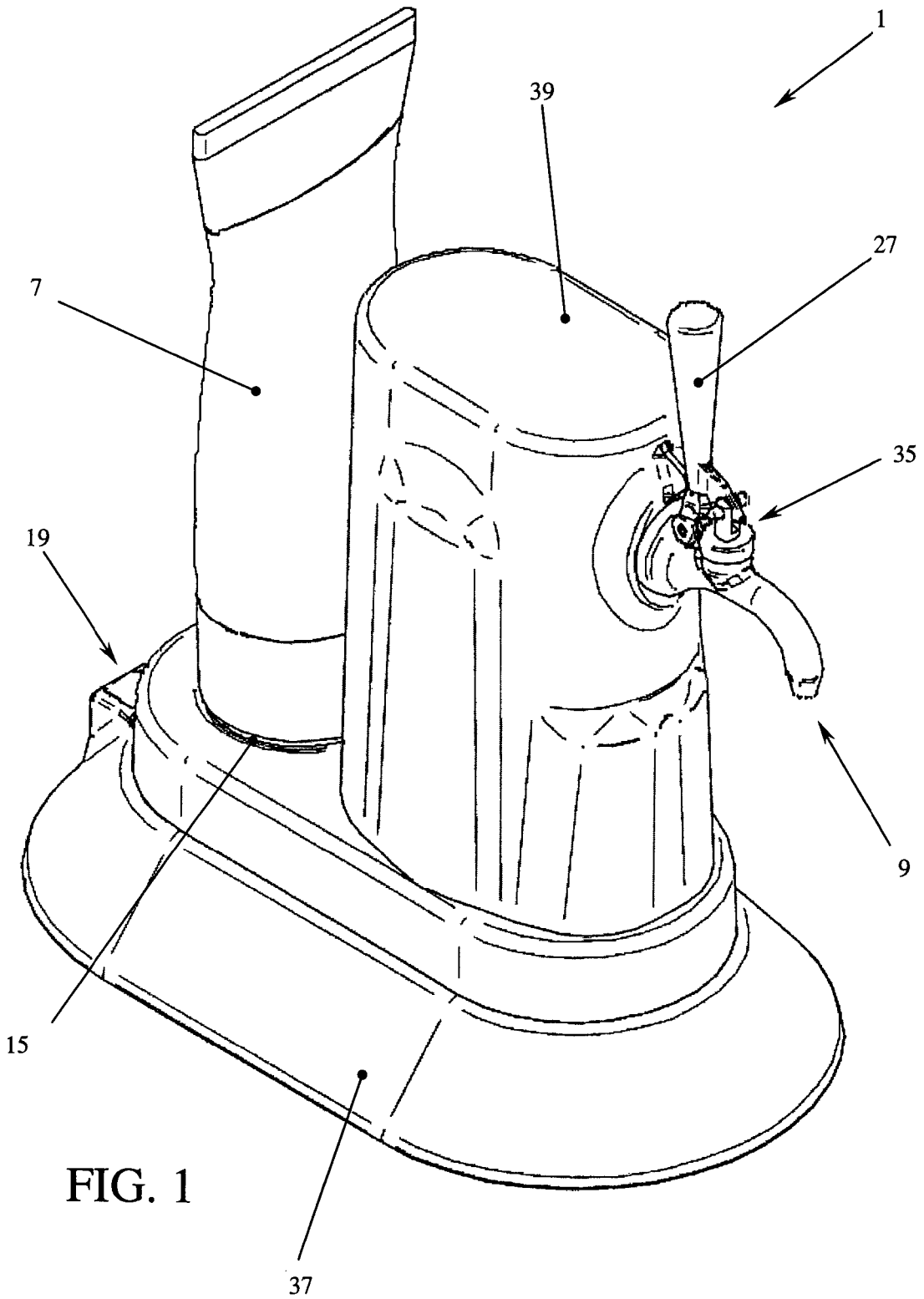
FIG. 1 shows a top perspective view of a preferred embodiment of the delivering device according to the present invention.
Figure 2:
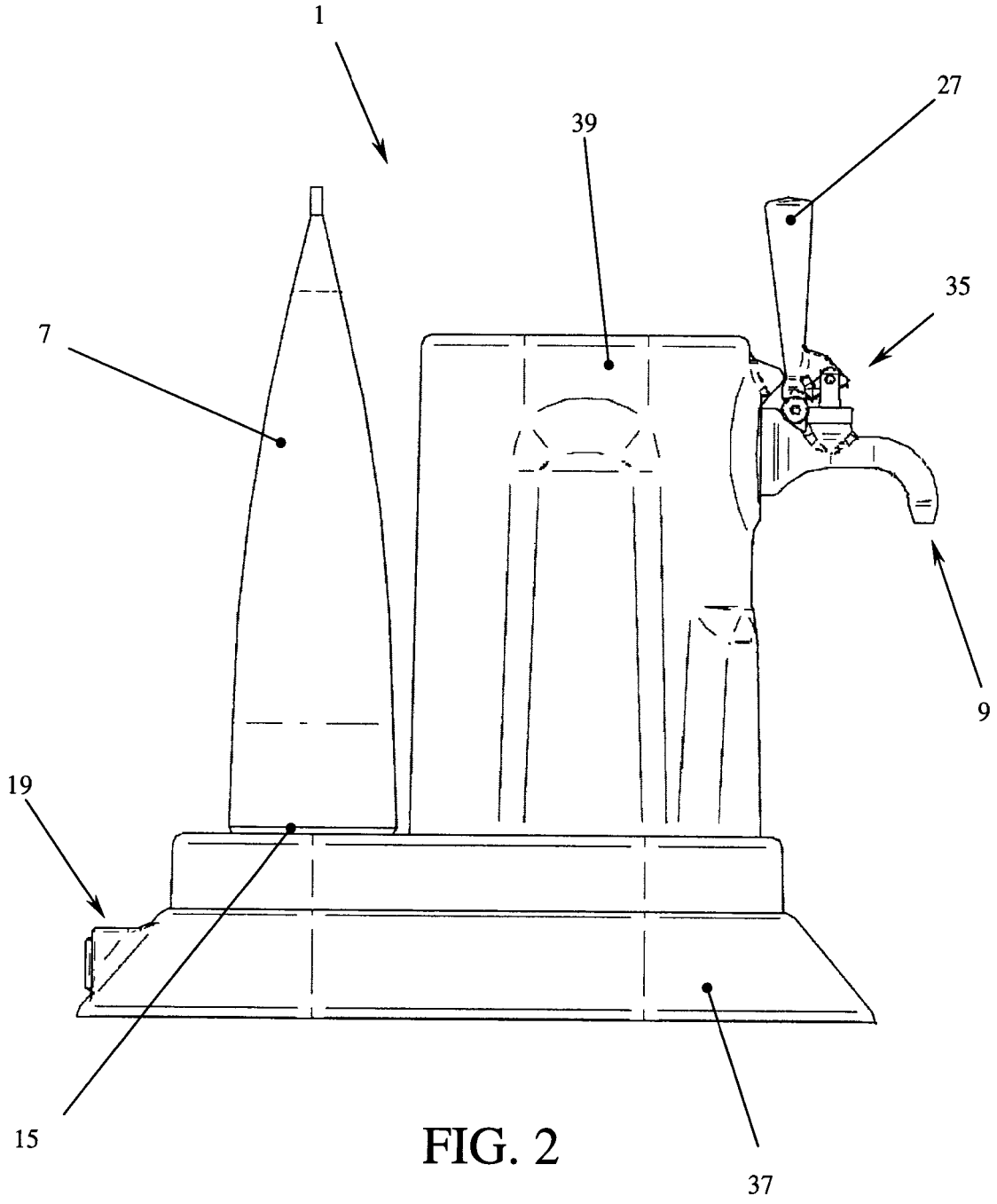
FIG. 2 shows a side view of the delivering device of FIG. 1.
Figure 3:
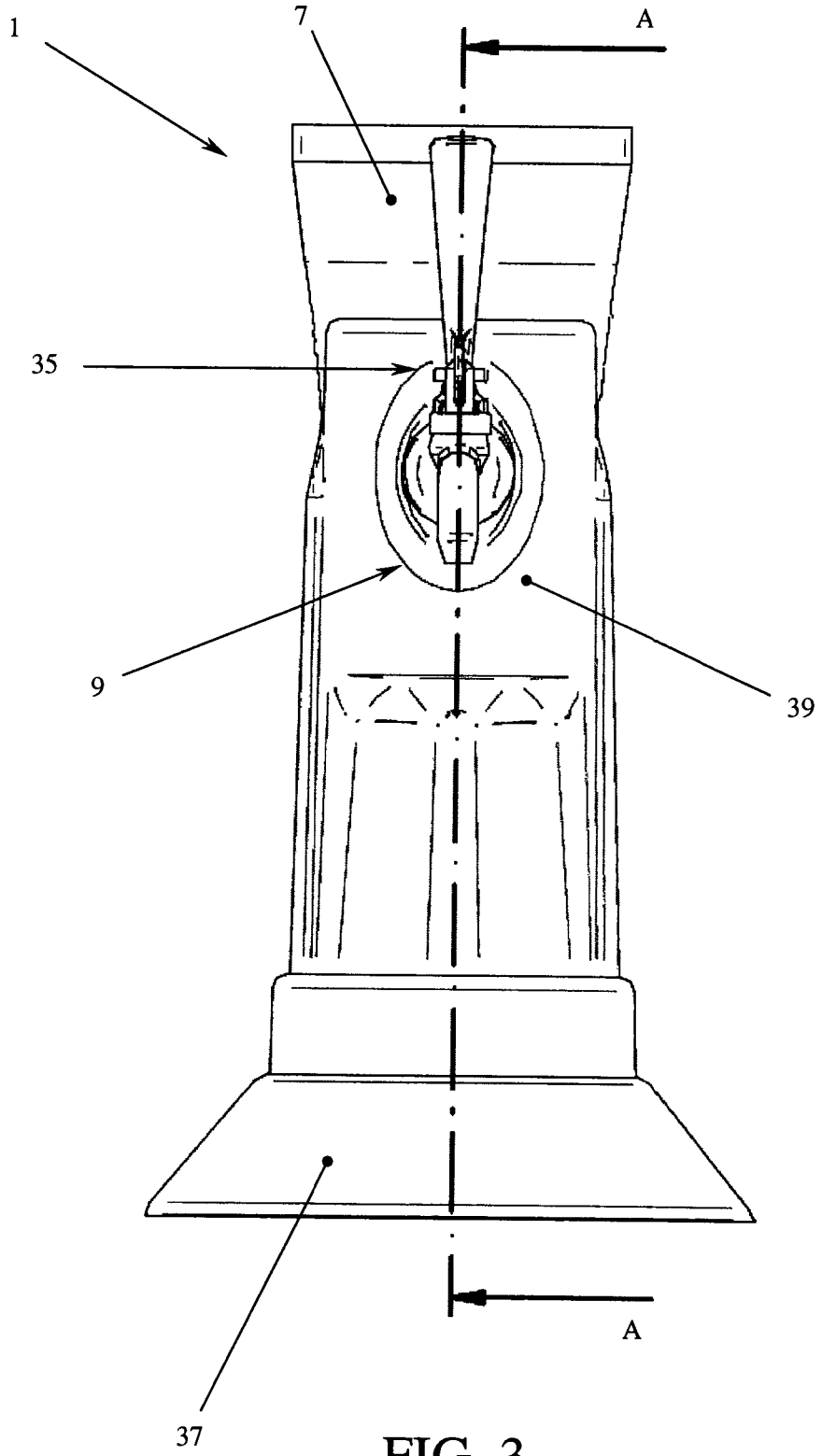
FIG. 3 shows a front view of the delivering device of FIG. 1.

With reference to the Figures, it is possible to note that the delivering device 1, in particular for pasty or creamy products such as for example soaps (toothpastes, etc.), cosmetics, foodstuff (creams, sauces, etc.) according to the present invention, preferably for domestic use, comprises at least one delivery duct 3 which fluid communicates at least one internal volume 5 of at least one container 7, the internal volume 5 containing therein at least one product, and at least one delivery nozzle 9 for exiting the product, by interposing pumping means 11 actuated by at least one actuating motor 13 for transferring product amounts from the internal volume 5 to the delivery nozzle 5 through the delivery duct 3.

The delivering device 1 according to the present invention further comprises suitable control means 14 actuated by a user and operatively cooperating with the actuating motor 13 to allow or inhibit at will the operation of the actuating motor 13 itself and respectively perform or stop the delivery of the product through the delivery nozzle 9.

Advantageously, the container 7 is a common container for selling the pasty product contained in its internal volume 5, and in particular it can be a common can or small tube (as shown in the Figures as an example): for such purpose, the delivery duct 3 can have an end equipped with at least one connecting neck 15 to an opening 17 of the container 7 communicating with the internal volume 5, the opening being preferably the product delivery neck from the container, usually closed by the respective pretecting cover. Preferably, the connecting neck 15 can allow a connection of the opening 15 through a simple connection due to elastic interference or engagement: alternatively, it is possible to provide that the connecting neck internally comprises at least one suitable threading corresponding to the common threading present outside the opening 15 for screwing the related protecting cover, in order to allow the connection of the container 7 to the connecting neck 15 through a similar screwing. In addition, it is possible to provide that the delivering device 1 according to the present invention comprises one or more interchangeable adapters (not shown) which can be inserted inside the connecting neck 15 to indifferently allow the connection, by elastic interference, engagement or screwing, of any one of the usually marketed containers 7 having, as known, openings 15 with mutually different threading diameters and/or pitches.

Obviously, the delivering device 1 according to the present invention can further comprise electric supply means for the actuating motor 13, being either antonomous and on board the same device 1 (such as, for example, one or more electric batteries, preferably of the rechargeable type) or comprising connection means 19 to a common electric supply mains outlet.

Figure 4:
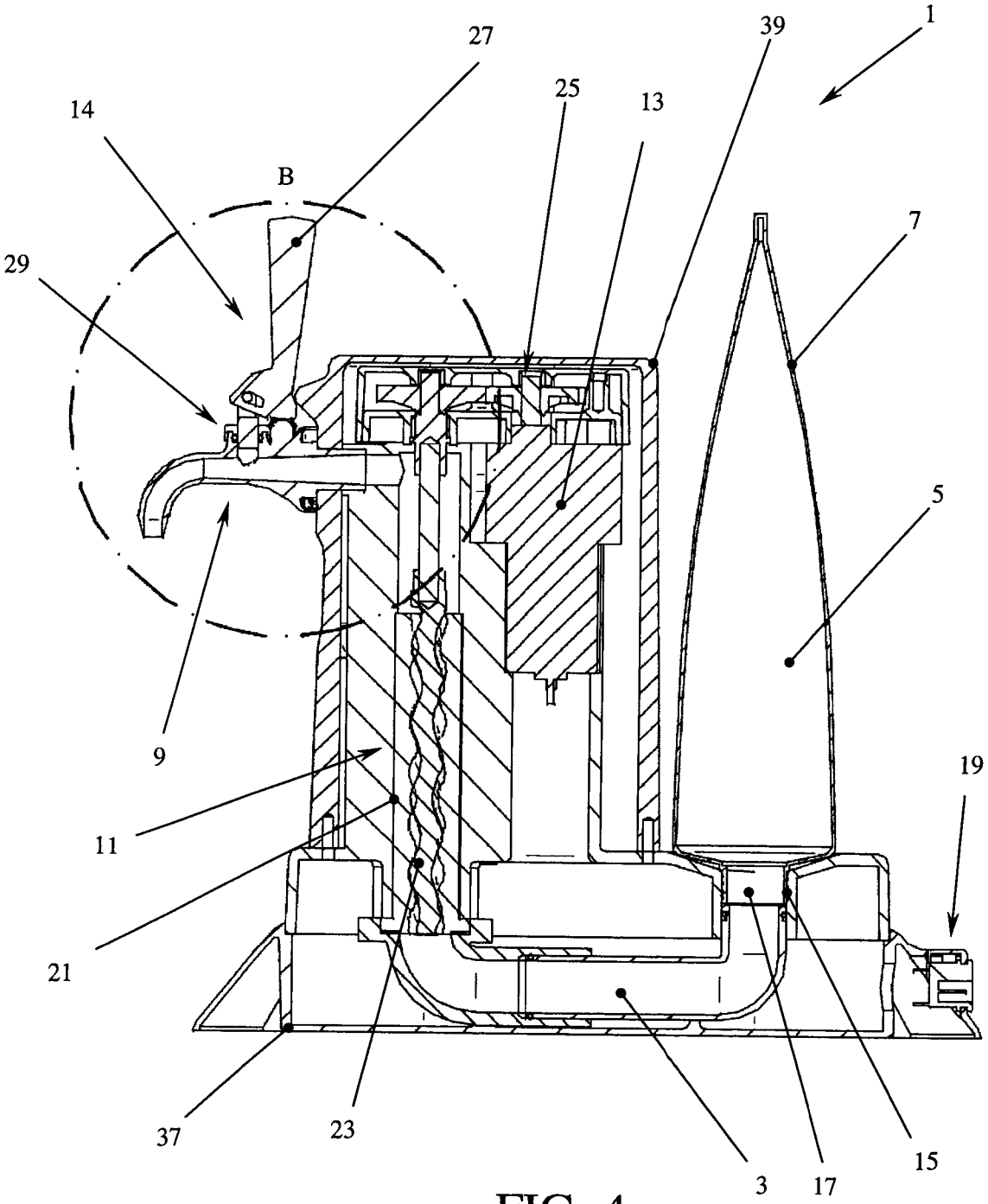
FIG. 4 shows a sectional view of the delivering device according to the present invention along section line A-A of FIG. 3.
Figure 5:
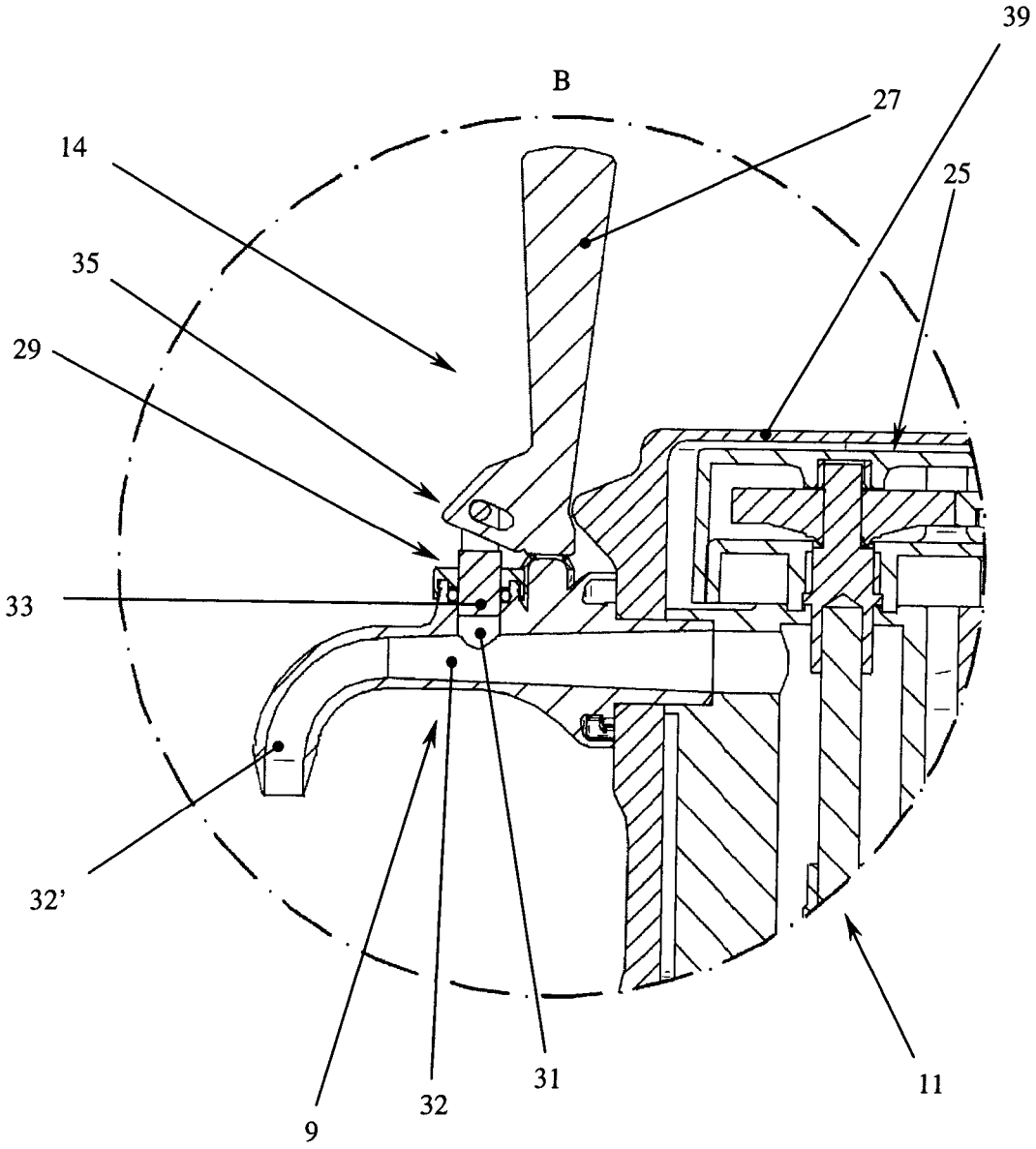
FIG. 5 shows an enlarged view of the detail enclosed in circle B of FIG. 4.

Preferably, the pumping means 11 comprise at least one pump with progressive recesses driven to rotate by the actuating motor 13. In particular, the pump with progressive recesses, arranged coaxially with the delivery duct 3, is substantially composed of an external stator casing 21 and of an internal rotor 23, driven to rotate by the actuating motor 13 to whose rotation shaft it can be connected directly or by interposing a suitable motion transmission kinematism 25 (such as, for example, a kinematism with a cascade of gears connecting the drive shaft of the actuating motor 13 to the internal rotor 23, like the one shown in particular in FIG. 4), the internal rotor 23 being shaped as worm screw with progressive recesses whose relative rotation with respect to the stator 21 generates a translation movement of the product therein. In particular, when actuated by the actuating motor 13, the pump with progressive recesses, during the rotation movement of its internal rotor 23, transfers certain volumetric amounts of the pasty or creamy product from the internal volume 5 of the container to the delivery nozzle 9 by interposing the delivery duct 3.

In particular, the control means 14, comprising at least one control lever 27 which can be actuated by a user, are adapted to pass from a control position of the actuation of the operation of the actuating motor 13, and then allow the delivery of the product through the delivery nozzle 9, to an inhibition position of the operation of the actuating motor 13, and then allow the delivery of the product through the delivery nozzle 9, and vice versa. Moreover, the control means 14 cooperate with at least one dripping-preventing system 29 preferably arranged along the delivery nozzle 9: in particular, the system 29 comprises at least one recess 31 in fluid communication with the section of delivery duct 32 of the nozzle 9 in a position included between the pumping means 11 and an end section 32' of the section of delivery duct of the nozzle 9, the recess 31 containing therein at least one sliding element 33 cooperating with the control means 14 in order to pass, by sliding inside the recess 31, from a first position with at least partial occupation of the internal volume of the recess 31 itself, when the control means 14 are in their control position of the actuation of the operation of the actuating motor 13, to a second position of at least partial disengagement of the internal volume of the recess 31, when instead the control means 14 are in their inhibition position of the operation of the actuating motor 13. In particular, the sliding element 33 can operatively cooperate with the control lever 27 by interposing a suitable hinge- or cam-type kinematism 35 for making the above described sliding movement inside the recess 31.

Advantageously, therefore, when the control means 14 are taken to their control position of the actuation of the operation of the actuating motor 13, the sliding element 33 is at the same time taken to its first position by sliding inside the recess 31 in order to at least partially occupy its internal volume without impairing the product passage through the section of delivery duct 32 of the nozzle 9; when instead, at the end of the desired delivery, the control means 14 are taken back to their inhibition position of the operation of the actuating motor 13, and therefore the product passage through the section of delivery duct 32 ceases, the sliding element 33 is taken to its second position by sliding inside the recess 31 in order to at least partially free its previously occupied, internal volume and performing a suction action, inside the volume itself of the recess 31, of the product remained inside at least the end section 32' of the section of delivery duct 32 of the nozzle 9, consequently avoiding any dripping outside.

In addition, the control means 14 can cooperate with control means (not shown) preferably made as a suitable electronic card, cooperating with the actuating motor 13, for automatically managing the operation of the pumping means 11 depending on the delivery of amounts of the product having a batching, preset or adjustable by the user. In particular, alternatively or in addition to the previously described dripping-preventing system 29, the control means could also cooperate with the actuating motor 13 so that, once having ended the delivery of the product, they drive the actuating motor 13 in order to impose to the internal rotor 23 a counter-rotation of a suitable entity as to suck part of the product remained inside the section of delivery duct 32, consequently avoiding possible drippings at delivery nozzle 9 level.

Moreover, the container 7 can be equipped with suitable recognizing means (not shown), such as for example a RFID label, externally arranged in a suitable position, adapted to identify at least the type of pasty or creamy product contained in its internal volume 5 and cooperating with related reading means of the recognizing means, so that the control means are able to know the exact type of pasty product contained inside the container 7, for example in order to suit the batching and delivering modes of the delivering device 1 depending on specific properties and reologic and viscosity features of the product.

Obviously, the delivering device 1 according to the present invention can further comprise a suitable supporting and containing structure adapted to support and contain the above described components. In particular, the structure can comprise at least one supporting base 37 comprising the above connecting neck 15 of the container 7 and at least one covering and protecting carter 39 at least of the actuating motor 13 and of the pumping means 11.

The invention claimed is:

1. A delivering device, in particular for pasty or creamy products comprising:

a housing having a base and a cover extending perpendicularly upward from the base;

at least one U-shaped delivery duct defined within the base of said housing, said at least one U-shaped delivery duct having at a first end a neck configured to receive at least one container at an opening of the at least one container to an internal volume of the at least one container, said at least one U-shaped delivery duct having rounded corners;

a pump having an external stator casing and an internal rotor shaped as a worm screw with progressive recesses, said pump being in fluid communication with a second end of said at least one U-shaped delivery duct and perpendicularly extending from the base of said housing into the cover of said housing;

a delivery nozzle disposed at an upper end of the cover of said housing, said delivery nozzle having a nozzle delivery duct therethrough in fluid communication with said pump, said delivery nozzle having drip preventing system including a recess in fluid communication with the nozzle delivery duct disposed between said pump and an end section of the nozzle delivery duct and a sliding element configured to slide within the recess;

at least one actuating motor disposed at the upper end of the cover of said housing, said at least one actuating motor having a drive shaft connected to the internal rotor by a cascade of gears, said actuating motor configured to drive rotation of the internal rotor of said pump within the external stator casing to transfer amounts of a product from the internal volume of the at least one container to said delivery nozzle through said at least one U-shaped delivery duct; and a controller having a lever at a first end, said controller configured to be actuated by a user and operatively cooperating with said actuating motor in order to allow or inhibit at will an operation of said actuating motor to drive or stop rotation of the internal rotor of said pump and delivery of the product through said delivery nozzle;

characterized in that said controller is adapted to pass from a control position of the actuation of the operation of said actuating motor to an inhibition position of the operation of said actuating motor and vice versa, said controller connected to the sliding element of the drip preventing system via a cam, the sliding element cooperating with said controller in order to pass, by sliding inside the recess, from a first position of at least partial occupation of an internal volume of the recess without impairing passage of the product through the nozzle delivery duct, when said controller is in the control position of the actuation of the operation of said actuating motor, to a second position of at least partial disengagement of the internal volume of the recess, when said controller is in the inhibition position of the operation of said actuating motor and passage of the product through the nozzle delivery duct ceases, the sliding element inside the recess moving from a first position of at least partial occupation of the internal volume of the recess to the second position of at least partial disengagement of the internal volume of the recess and the second position also imposing a counter-rotation on the internal rotor to suck part of the product remaining inside the end section of the delivery duct of said delivery nozzle after a desired amount of the product has been delivered.

2. The delivering device according to claim 1, characterized in that the neck at the first end of said at least one U-shaped delivery duct is adapted to allow a connection of the opening of the at least one container through connection by elastic interference or engagement.

3. The delivering device according to claim 1, characterized in that the neck at the first end of said at least one U-shaped delivery duct internally comprises at least one threading corresponding to a threading present externally to the opening of the at least one container to allow a connection of the at least one container to the connecting neck through screwing.

4. The delivering device according to claim 1, further comprising one or more interchangeable adapters which can be inserted inside the neck at the first end of said at least one U-shaped delivery duct to allow a connection, by elastic interference, engagement or screwing of any one of the containers.

5. The delivering device according to claim 1, characterized in that said controller cooperates with said actuating motor to automatically manage an operation of said pump as function of a delivery of amounts of the product having a batching preset or adjustable by a user.

6. The delivering device according to claim 5, characterized in that said controller cooperates with said actuating motor in order to impose to the internal rotor a counter-rotation to suck part of the product remained inside the end section of the nozzle delivery duct.

7. The delivering device according to claim 6, characterized in that the container is equipped with a label adapted to identify at least one type of the product contained inside the internal volume and cooperating with a related reader of said label.

8. The delivering device according to claim 1 wherein the at least one container is vertically oriented with the opening of the container positioned below the internal volume of the container.

9. The delivering device according to claim 1 wherein a central longitudinal axis of the worm screw is separated from a central longitudinal axis of the container by said U-shaped delivery duct.

10. The delivering device according to claim 9 wherein the central longitudinal axis of the worm screw is parallel to the central longitudinal axis of the container.

* * * * *